United States Patent [19]

Gentry

[11] 3,974,946

[45] Aug. 17, 1976

[54] PLEAT MEASURING AND FORMING DEVICE

[76] Inventor: Pat Gentry, 142 W. 222nd St., Carson, Calif. 90745

[22] Filed: Aug. 8, 1975

[21] Appl. No.: 602,979

[52] U.S. Cl. ..... 223/34; 160/348; 33/176

[51] Int. Cl.[2] ..... A41B 43/00; D06J 1/00

[58] Field of Search ..... 223/28, 33–35; 33/137 R, 192, 174 G, 174 R, 107 R, 111, 178 B, 176, 179; 160/348; 112/427

[56] References Cited

UNITED STATES PATENTS

| | | | |
|---|---|---|---|
| 3,132,686 | 5/1964 | Judorits | 160/348 |
| 3,166,854 | 1/1965 | Packer et al. | 33/192 |
| 3,570,580 | 3/1971 | Warner | 160/348 |
| 3,645,000 | 2/1972 | Gass | 223/34 X |
| 3,712,520 | 1/1973 | Vipond | 223/34 |

*Primary Examiner*—G. V. Larkin
*Attorney, Agent, or Firm*—Singer & Singer

[57] ABSTRACT

A device to facilitate the pleating of a fabric material comprising a substantially flat sheet of plastic having alternating scorings on each side of the plastic device. On one side the scorings have a substantially V-shaped cross-section and on the opposite side the scorings have an arcuate cross-section. The scoring lines are parallel to each other and are equally spaced from each other to thereby facilitate folding the plastic device accordion style.

16 Claims, 13 Drawing Figures

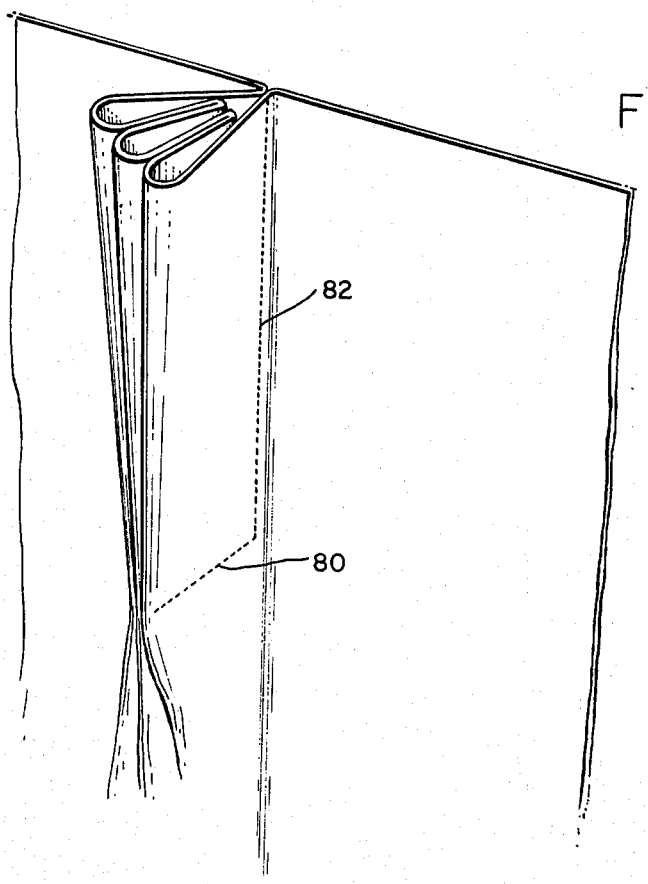
Fig. 4.
Fig. 5.
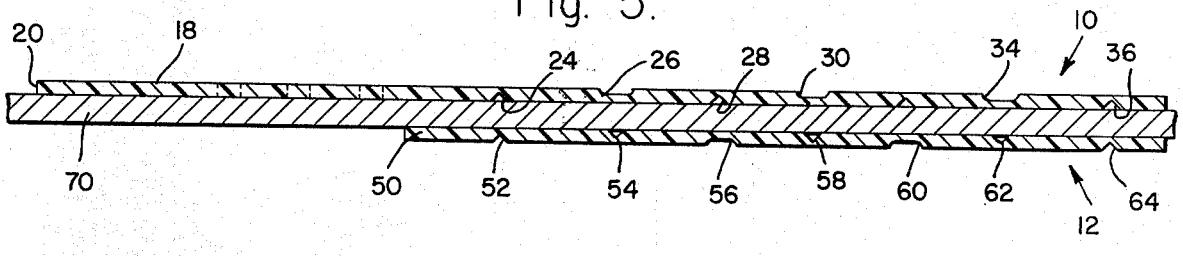
Fig. 6.
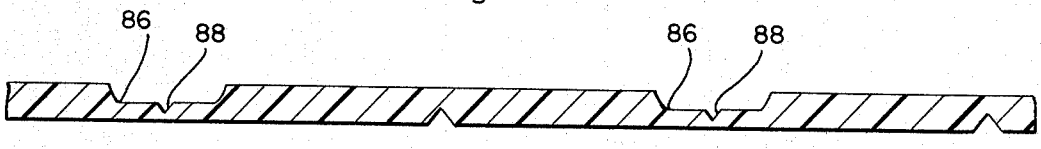

Fig. 8.
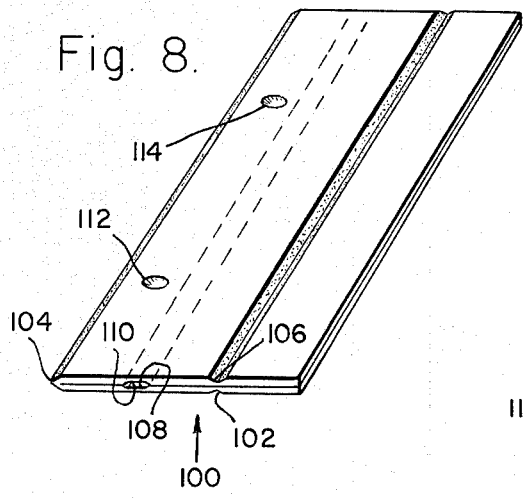
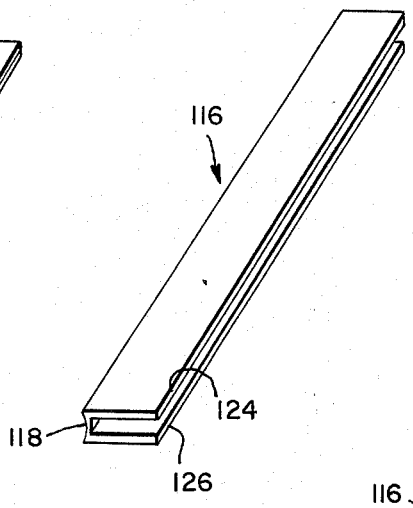
Fig. 10.
Fig. 9.
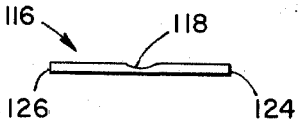
Fig. 11.
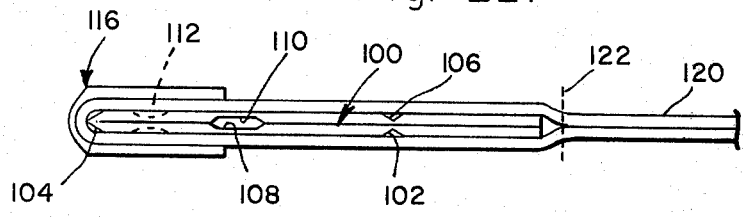
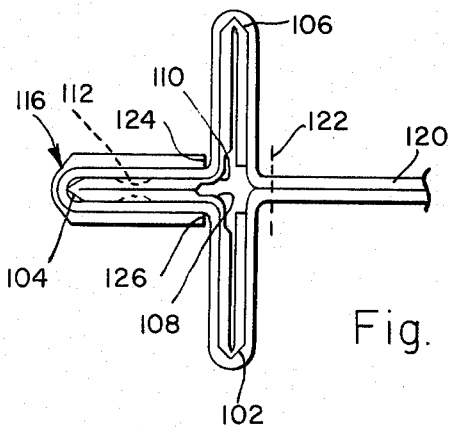
Fig. 12.
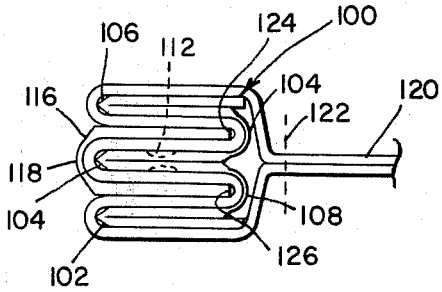
Fig. 13.
Fig. 7.
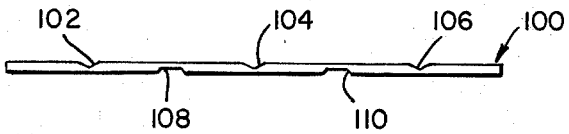

PLEAT MEASURING AND FORMING DEVICE

This invention relates to a pleat measuring and forming device for accurately reproducing identical pleats in a fabric material and more particularly to a device that is capable of being used by relatively inexperienced and untrained persons for reproducing identical pleats in a repetitive manner.

In the art of room decorations it is considered fashionable to produce drapes and other wall coverings of a fabric material having a plurality of consecutive and repetitive pleats formed in the heading portion of the material.

Pleats are usually created at the uppermost portion of the hanging material by gathering a given amount of material for each pleat and reproducing the process for the full width of the hanging material. This gathering process generates a fullness of material which allows the total fabric to hang in a more decorative form over a wall portion rather than hang flat which would be the result of using material without pleats.

The beauty of a hanging material that is properly pleated resides in the symmetry of the identical pleats that allow the fabric to fold in their normal hanging position.

A butterfly pleat or pinch pleat is generated by folding material three times, which material is then stitched together to form a pleat. A skilled seamstress will accurately measure the heading material in such a manner as to allow a leader portion for attachment to the drapery hardware and thereafter pleats are measured in groups of uneven numbers such as 5, 7 or 9, or as many as are required to take up the amount allowed for fullness. The fullness of each type of pleat and space between pleats depends on the weight of the material and the amount allowed for fullness.

The usual procedure is to measure and mark the exact position and width for all pleats and spacing before stitching.

The seamstress will then divide the single large pleat evenly into three smaller pleats, press the fold in firmly and stitch across the three folds at the lower edge of the heading comprising the pleat.

Experience has shown that making one pleat is not a particularly difficult procedure, however, the problem results from the fact that each pleat must be constructed uniformly and identical to the previous pleat and that all pleats must be completely parallel to each other in order for the resulting drapery material to hang properly and fold in the desired fashion.

Experience has shown that the average person is not able to construct and hang pleated drapery material. The problems invariably result from the fact that the individual pleats are not identical to each other and further that the pleats are not parallel to each other.

It is almost impossible to hang drapery material across an expansive wall portion where the pleats are not parallel or are unequal. Unequal pleats result in an uneven adjustment of the drape with respect to the drapery hardware, thereby unduly affecting the folds and fullness of the material as they hang from the hardware. Individual pleats that are not parallel with each other have the same effect of gathering the material at discrete locations, thereby causing the material to pull which disturbs the symmetrical fullness of the material in the hanging position. Attempts to adjust the material on the rod after the pleats have been constructed improperly is at best unrewarding since the end result is never satisfactory.

The expert seamstress having the proper tools and training knows that the key to a properly hanging fabric material resides in the care and detail of measuring identical pleats that are each parallel to each other. As in all other trades there is no substitution for care and attention to meticulous details in performing the functions of the trade.

This invention is concerned with an apparatus that will allow an average seamstress to reproduce pinch pleats in a fabric material that are each equally spaced one from the other and in which each pleat is parallel to the other.

In the present invention a guide is used to help fold the material accordion style into a pinch pleat.

The guide is preferably constructed of plastic having a thickness of approximately 0.050 inch. The plastic guide contains a plurality of parallel equally spaced scorings located alternately on each side of the plastic.

The scorings on one side of the plastic preferably have a substantially V-shaped cross-section whereas the scorings on the opposite side of the plastic preferably have an arcuate cross-section. The distances between the V-shaped scorings and the arcuate scorings are equal and hence the scorings are parallel to each other. Having the scorings on opposite sides of the plastic device facilitates folding the device accordion style to produce the defined pinch pleat.

The pleat measuring and forming device consists of a second plastic device having V-shaped scorings on one side and arcuate scorings on the other in which the scorings are parallel to each other and equally spaced one from the other in the same fashion as defined for the first plastic device.

In the preferred embodiment both the first and second plastic devices are pivotably attached to each other and aligned so that the V-shaped scorings on the first device nest within the arcuate scorings on the second device and the V-shaped scorings on the second device nest within the arcuate scorings on the first device. It will be recognized by those skilled in the art that the first and second device may be constructed of a single sheet of plastic having the scorings as defined.

The pleat is formed by placing the header material of the fabric across the first plastic device and folding the second plastic device thereover so as to hold the fabric in a fixed position within the first device and second device as in a sandwich. A lateral force on the plastic allows both plastic devices nesting one within the other to fold accordion style thereby generating a pinch pleat. The operator holds the pleat in position, withdraws the first and second plastic device, and sews the pleat lengthwise on the header material behind the pleat to fix the pleat in position. In addition a stitch is located on the lowermost portion of the header material across the pleat, thereby fixedly locating and positioning the pleat in two positions.

The prior art has attempted in different ways to provide apparatuses that would enable an inexperienced person to manufacture pleats. Unfortunately, however, the prior art devices did not recognize the need for manufacturing each pleat identical with the other and the fact that each pleat must be parallel one with the other in order to produce a hanging drapery material with the fullness that one expects as a result of using pleats.

A review of the prior art shows U.S. Pat. No. 3,824,964 issued July 23, 1974 to Richard B. Ryan for an automatic pleater for draperies. The Ryan patent discloses a complete machine for use with a sewing machine that gathers folds and ultimately sews the pleats together. The pleat making machine disclosed by Ryan is not a simple tool for the average homemaker but rather a complete machine for use by a factory in the business of making professional drapes for the industry. Interestingly, the Ryan patent does not recognize that the heart of making a pleat is in the repetitive equal measuring of parallel pleat sections.

U.S. Pat. No. 3,132,686 issued May 12, 1964 to M. Judovits entitled Drape Pleating Device and Fastener shows a pleating arrangement and drapery hardware material for creating the pleat and special hardware for hanging the finished pleat. In the Judovits device the pleats are created by the accordion device disclosed by Judovits but unfortunately the device and the special hooks and drapery hardware used by Judovits must all be assembled and hung with the fabric material.

U.S. Pat. No. 3,570,580 patented Mar. 16, 1971 and issued to Philip D. Warner entitled Fabric Pleating Guide illustrates a very basic guide for creating an accordion type configuration. This patent recognizes a very basic problem in manufacturing pleats which is the fact that the fabric of the material being pleated has a substantial thickness that is usually enhanced by the fact that the header material invariably contains a stiffener material of buckram or other material to provide more body for the pleated portion of the fabric material.

The extra thickness of the material therefore interferes with the use of single identical guides adapted to be folded accordion style. The Warner patent recognizes that the thickness of header material must be accounted for and he therefore creates a fabric material having pocket portions for accepting battens which form the side of the individual pleats when his guide is folded into the accordion configuration. Unfortunately, Warner does not solve the problem of generating straight parallel pleats because the fabric distance between adjacent battens must fold in two directions, one around the fabric material being formed into the pleat, and second, must provide a very sharp radius where the pleated material folds about the sharp point to accommodate the accordion fold. The fabric distance between adjacent battens does not provide the rigidity or the uniqueness for causing the accordion fold to occur at the same point for each fold, thereby allowing repetitive pleats to be non-parallel because of the movement of the material between adjacent platens. There is further no recognition of the problem in the Warner patent that the pleats must be parallel nor is there shown any suggestion of how his device may be modified to create uniquely parallel pleats that are so necessary and desired in the finished product.

Further objects and advantages of the present invention will be made more apparent by referring now to the accompanying drawings wherein:

FIG. 4 illustrates a finished pleat;

FIG. 5 is a cross-section of FIG. 2 taken along line 5—5;

FIG. 6 illustrates a second embodiment for the arcuate scorings;

FIG. 7 illustrates a perspective view of a second embodiment of a pleat measuring and forming device;

FIG. 8 illustrates a substantially U-shaped member for use with the pleat measuring and forming device of FIG. 7;

FIG. 9 is a side view illustrating how the device of FIGS. 7 and 8 are used to create a pinch pleat;

FIG. 10 illustrates still another step in creating a pinch pleat using the device of FIGS. 7 and 8; and FIG. 11 illustrates the final step in creating a pinch pleat using the device of FIGS. 7 and 8.

Figure 1:
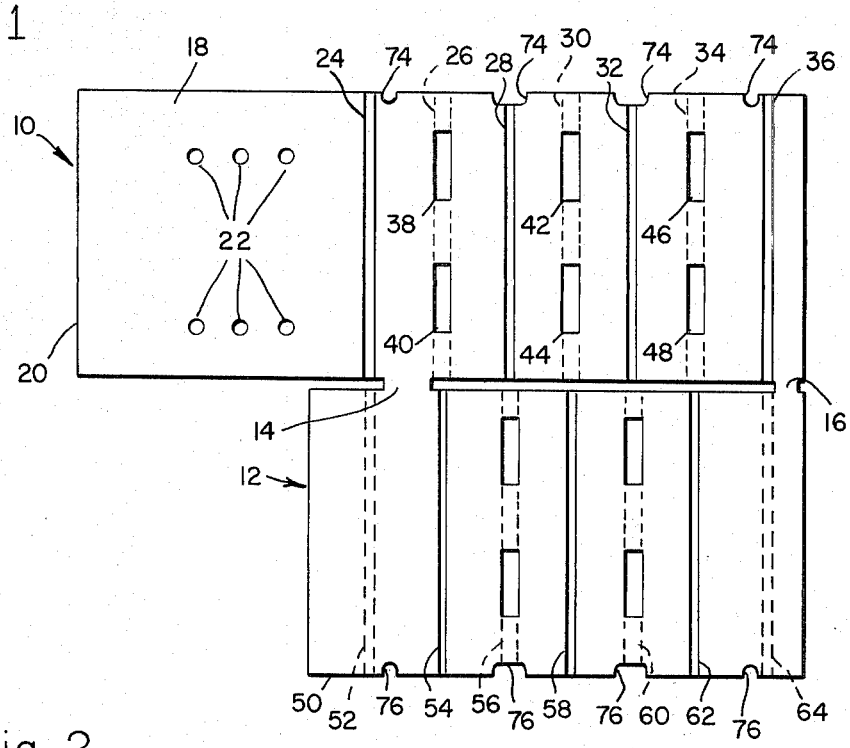
FIG. 1 is a plan view illustrating the pleat measuring and forming device in an open position.

Referring now to FIG. 1 there is shown a pleat measuring and forming device constructed according to the teachings of this invention. The device is formed of a top portion 10 and a bottom portion 12 which in the first embodiment are fixedly attached to each other by means of fixed pivot portions 14 and 16 to thereby allow top portion 10 to fold over bottom portion 12.

In the preferred embodiment the top portion 10 and bottom portion 12 are preferably constructed of a substantially flat plastic material having a thickness of approximately 0.050 inch. The completed device may be constructed of a separate top portion 10 and a separate bottom portion 12 which are then fixedly attached to each other by means of hinge 14 and 16 or the complete assembly may be constructed of a single plastic sheet that is suitably stamped and scored in the manner taught by this invention.

The top portion 10 contains a spacing guide 18 having an edge 20 adapted to be placed against a previously constructed pleat as will be more fully explained in connection with FIG. 2. The spacing guide 18 also contains a plurality of spaced-apart holes 22 for use with extension spacing guides not illustrated. The spacing between individual pleats usually varies between 3 to 4½ inches. The length of spacing guide 18 is preferably made three inches long to accommodate the minimum spacing between adjacent pleats. In the event the user desires varying spacing it is only necessary to use an additional spacing guide having posts adapted to mate with holes 22 to thereby obtain any longer distance between adjacent pleats.

By referring now to FIG. 1 and FIG. 5, details of the scorings contained in the top portion 15 will be made more apparent.

By way of review it should be emphasized that the purpose of the scorings is two-fold in that the pleat measuring and forming device is made adaptable to fold in an accordion fashion and at the same time the shape and location of the individual scorings is chosen so as to facilitate the folding of the device along the scored mark so that the distance between adjacent scorings is always equal and the fold uniquely takes place along each scoring to thereby produce identically repetitive pleats.

Adjacent the spacing guide 18 is a first scoring 24 preferably having a V-shaped cross-section. The scoring is located on the bottom face of the top portion 10.

Located a fixed distance from the center line of the V-shaped scoring 24 is a scoring 16 having an arcuate cross-section located on the top face of the top portion 10. The arcuate cross-section of scoring 26 is chosen to accommodate the thickness of the fabric of the material being pleated.

In a repetitive manner a V-shaped cross-section scoring 28 located the same fixed distance from arcuate scoring 26 is located on the bottom face of top portion 10, as is arcuate scoring 30, V-shaped scoring 32, arcuate scoring 34, and V-shaped scoring 36.

The distance between the center line of the V-shaped scoring 24 and the center line of the arcuate scoring 26 is the same as the distance between all adjacent scorings. In addition it will be observed that all V-shaped scorings 24, 28, 32 and 36 are located on the bottom face of the top portion 10 whereas the arcuate scorings 26, 30 and 34 are located on the top face of the top portion 10.

As an optical feature, openings 38 and 40 are located on the center line of the arcuate scoring 26 in order to facilitate the folding of the device into the accordion type configuration. In a similar fashion, openings 42 and 44 are located in arcuate scorings 30 and openings 46 and 48 are located on the center line of arcuate scorings 34.

Referring now to FIG. 1 and FIG. 5, there is shown the details of the bottom portion 12 and the individual scorings located on the bottom portion and the relationship between the scorings located on the bottom portion 12 to the scorings located on top portion 10.

The bottom portion 10 contains a short guide 50 that has no special function other than being shorter than spacing guide 18 so as not to interfere with the function of the spacing guide or the use of the holes 22 located on the spacing guide.

Located on the bottom face of the bottom portion 12 and aligned with scoring 24 is a V-shaped cross-section scoring 52. Located on the top face of the bottom portion 12 is a V-shaped cross-section scoring 54 in which the center line of the scoring 54 is aligned with the center line of the arcuate scoring 26 located on the top portion 10.

Located on the bottom face of the bottom portion 12 is an arcuate scoring 56 having a center line that is aligned with the center line of the V-shaped scoring 28 located on the top portion 10.

In a similar fashion, V-shaped scoring 58 is aligned with scoring 30 whereas arcuate scoring 60 is aligned with V-shaped scoring 32 and V-shaped scoring 62 is aligned with arcuate scoring 34 and V-shaped scoring 64 is aligned with V-shaped scoring 36.

A review of the bottom portion 12 will show that the top face of the bottom portion contains V-shaped cross-section scorings 54, 58 and 62 aligned with arcuate scorings 26, 30 and 34, all located on the top face of the top portion 10.

A review of the bottom face of the bottom portion 12 shows that V-shaped cross-section 52, arcuate scoring 56, arcuate scoring 60, and V-shaped scoring 64 are each aligned respectively with scorings 24, 28, 32 and 36 all located on the bottom face of the top portion 10.

Figure 2:
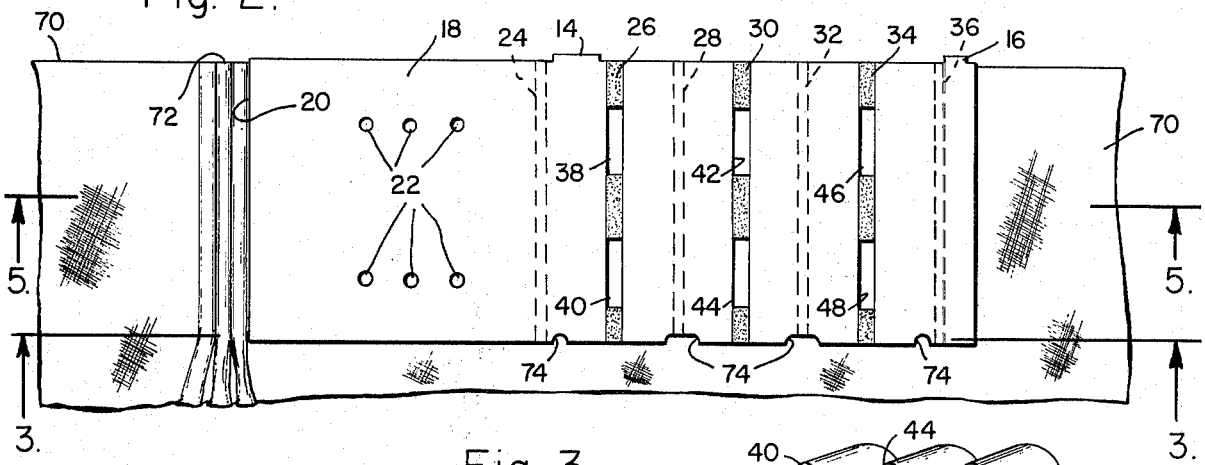
FIG. 2 is a plan view illustrating the pleat measuring and forming device in a closed position on the header portion of a fabric material.

Referring now to FIG. 2 there is shown a plan view of how the pleat measuring and forming device is used.

For purposes of illustration we will assure that the header material 70 consists a pinch pleat 72. The bottom portion 12 is placed underneath the header material 70 and the top portion 10 is folded over the material so as to pivot on hinges 14 and 16.

The complete assembly comprising the top portion 10 and the bottom portion 12 is moved laterally along the header 70 until the edge 20 of the spacing guide 18 abuts against pleat 72. In this fashion the spacer guide 18 provides the desired spacing between pleat 72 and the next pleat to be formed. The placing of the top portion 10 and bottom portion 12 is repeated as shown in FIG. 2 after each pleat is formed.

Figure 3:
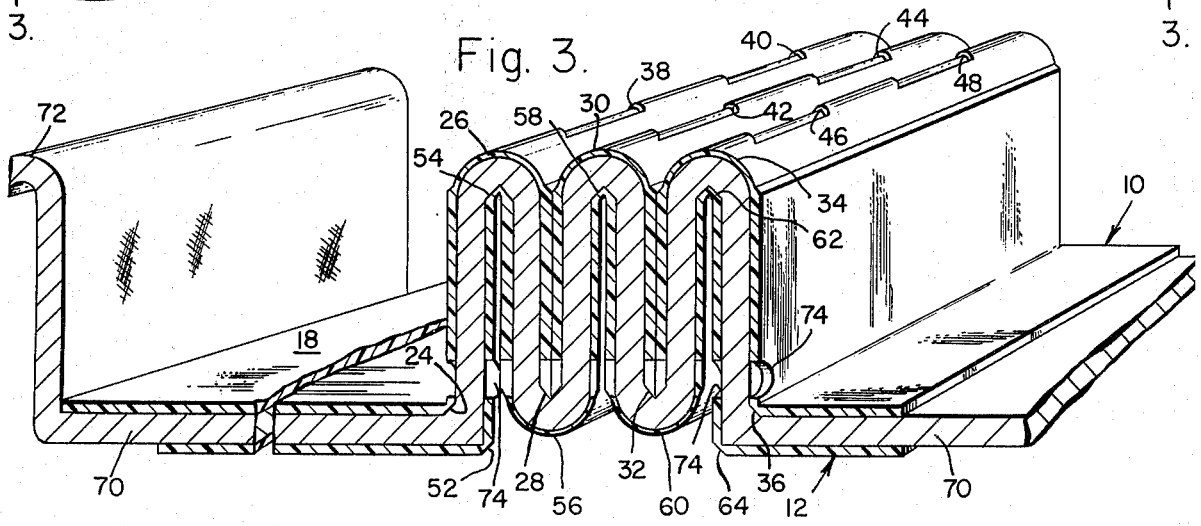
FIG. 3 is a cross-section view of the pleat measuring and forming device of FIG. 2 folded accordion style with the header fabric material in place.

Referring now to FIG. 3 there is shown a cross-section of FIG. 2 taken along line 3—3 in order to more fully illustrate how the action of the V scorings cooperate with the arcuate scorings to produce the uniform pleat.

The cross-sectional illustration of FIG. 3 has been enlarged in order to more properly illustrate how the thickness of the material 70 is compensated for when the top portion 10 is folded over the bottom portion 12 and a lateral force is applied to produce the accordion style pleating action.

In making the pleat the spacing guide 18 is positioned against the previous pleat 72 as shown in FIG. 2. The header 70 is straightened out and then the operator holds the space guide 18 to prevent movement while at the same time generates a lateral force with his other hand and pushes to the left so as to cause both the top portion 10 and the bottom portion 12 to pivot about scorings 24 and 52 and 36 and 64, respectively.

As the lateral force to the left is increased the bottom portion 12 will pivot about the V-shaped scorings 54, 58 and 62 while the top portion 10 will pivot about the V-shaped scorings 28 and 32.

During this operation the material 70 and the top portion 10 and the bottom portion 12 are folded in unison into an accordion type configuration.

The individual folds of the pleat are formed between each opposing V-shaped scoring and an opposing arcuate scoring as between V-shaped scoring 54 and arcuate scoring 26, V-shaped scoring 28 and arcuate scoring 56, V-shaped scoring 58 and arcuate scoring 30, V-shaped scoring 32 and arcuate scoring 60, and V-shaped scoring 62 and arcuate scoring 34.

It will be appreciated that each of the arcuate scorings provides the radius of curvature sufficient to allow the header material 70 to fold precisely around a V-shaped scoring thereby allowing each formed pleat to be precisely, accurately and uniquely formed, one with respect to the other. The resulting pleats are therefore straight and uniform and reproduce exactly as the previous pleat since the cooperating top portion 10 and bottom portion 12 allow the corresponding V scorings to nest within the central portion of the arcuate scorings in the same unique relationship for each and every pleat.

The finished pleat is tacked in place by the operator by passing two or three tacking threads through openings 74 located in the top portion 10 and openings 76 located on the bottom portion 12. The openings 74 and the openings 76 are positioned so that they align as shown in FIG. 3 when the top portion 10 is folded over the fabric 70 and the pleat is formed as illustrated in FIG. 3.

Referring now to FIG. 4 there is shown the pleat with the tacking threads in place and the top portion 10 and the bottom portion 12 having been removed. The operator now holds the pleat in a finished form and places a stitch across the three folds at the lower edge of the heading as at 80 to tie the pleat together. The pleat is finished after the operator runs a backing stitch 82 across the back of the pleat tying the fabric together.

Referring now to FIG. 6 there is shown another embodiment for the arcuate scoring illustrated in connection with FIGS. 5 and 6.

For certain extremely thick fabrics the arcuate scoring would by necessity have to be large enough to accept the material as it is folded around the V-shaped scoring as shown in FIG. 3. In order to ensure that the arcuate scoring 86 will curve the material about the same point, a second V-shaped cross-section 88 may be inserted in the central portion of the arcuate scoring 86 and running the length of the scoring. In this fashion the arcuate scoring 86 will always fold about a central V-shaped scoring 88 regardless of the radius of curvature of the arcute scoring 86. In this fashion the arcuate scoring 86 will always fold precisely about the cooperating V-shaped cross-section as the heading material is folded and formed to form a pleat.

Referring now to FIGS. 7, 8, 9, 10 and 11, there is shown another embodiment for creating the pinch pleat utilizing two separate members that are not physically attached to each other.

By way of review, the simplest procedure to form a pinch pleat is to uniformly gather a fold of material which is stitched together at the gathered point. This procedure is followed for the length of the material, leaving the operator with a plurality of large pleats uniformly created along the header of the hanging material. The pinch pleat is created by dividing the large pleat evenly into three smaller pleats which is then stitched across the three folds at the lower edge of the heading.

The expert seamstress through years of experience is able to manipulate the large pleat by hand into three smaller pleats. However, the inexperienced seamstress is totally lacking in this dexterity and the end result results in pleats that unfortunately vary from one to the other in that the three smallest pleats divided from the large pleat are unequal and hence unsightly.

The embodiment described in FIGS. 7, 8, 9, 10 and 11 illustrates how the principles of this invention may be utilized by having two separate guide members cooperate to produce three equal smaller pleats from a single large pleat.

Referring now to FIG. 7, there is shown a cross-section of a lower member 100 having three equally spaced scorings 102, 104, and 106, located on the upper side of the lower member 100. Located on the bottommost side of the lower member 100 are two arcuate cross-sections 108 and 110 and situated so that arcuate scoring 108 is located between V-shaped scoring 102 and 104 and arcuate scoring 110 is located between V-shaped scoring 104 and 106. The spacings between the center line of the V-shaped scoring 102 and the center of arcuate scoring 108 is equal to the distance between the center line of arcuate scoring 108 and the center line of V-shaped scoring 104. Similarly, the measured distance between V-shaped scoring 104 and arcuate scoring 110 is equal to the distance between arcuate scoring 110 and V-shaped scoring 106 thereby ensuring that all measured distances are the same.

The lower member 100 is preferably constructed of a thin sheet of relatively stiff plastic material having a thickness of approximately 0.050 inch. The length of the lower member 100 is calculated to be a distance that is twice the distance of the single large pleat which is to be formed into a pinched pleat.

Referring now to FIG. 8, there is shown the lowest member 10 folded about the V-shaped scoring 104. The folded lowest member 100 is tacked together on one side between V-shaped scoring 104 and arcuate scoring 110 and on the other side between V-shaped scoring 104 and arcuate scoring 108 by means of tacking points 112 and 114. In one embodiment small staples were used to attach opposing ends of the plastic together.

Referring now to FIG. 9, there is shown an upper member 116 and cross-section having a single arcuate scoring 118 located only on one side of the upper member.

Referring now to FIG. 10, there is shown the upper member 116 folded into a U-shaped form having two equal legs.

Referring now to FIG. 11, there is shown a folded lower member 100 in which the header fabric material 120 is shown completely encircling the folded lowest member at the place where the seamstress tends to create the first large pleat. At the point where the folded material 120 completely encircles the lower member 100, the material 120 is stitched together by a suitable backing stitch 122. The stitch located at 122 determines the position of the pleat which is to be formed from the looped material 120. The folded lower member 100 performs the dual function of measuring the necessary material for the big loop and also provides the basis for dividing the material 120 into three equal portions to form the pinched pleat.

The folded upper member 116 as illustrated in FIG. 10 is placed around the material 120 about the V-shaped cross-section 104. In this position the seamstress holds the upper member 116 in one hand about the material 120 and with the other hand pushes the lower member 100 and the folded member 120 towards the upper member so as to cause the lower member to pivot about the arcuate scorings 110 and 108 as shown in FIG. 12. At the same time that the lower member 100 pivots about the arcuate member 110 and 108 the lower member is also folding about V-shaped scoring 106 and V-shaped scoring 102.

FIG. 12 illustrates the intermediate step and position that allows the lower member 100 to pivot as described. It will be appreciated that the end portions 124 and 126 of the upper member 116 form the pivoting point for the material 120 as the lower member pivots about the scorings 110 and 108.

Referring now to FIG. 13, there is shown the final step that results from forcing the upper member 116 so as to fold the lower member 122 into the accordion fashion for forming the pinch pleat. An analysis of FIG. 13 will show that end portion 124 nests within arcuate scoring 110 and end portion 126 nests within arcuate scoring 108 to thereby ensure that the material is properly formed along straight and parallel and equal spaced scoring positions. Similarly, the center pleat is formed between V-shaped scoring 104 and arcuate scoring 118 located on the upper member 116.

The seamstress that removes the U-shaped upper member 116 thereby leaving a properly formed pinch pleat that needs only be tacked at the bottommost portion of the pleat across all three folds as illustrated by stitching 80 in FIG. 4.

It will be appreciated by those skilled in the art that the inventive concept for both embodiments comprise the mechanization of folding the guide about predetermined scorings in which a first scoring forms an anvil and a second cooperating scoring provides space for the fabric material to fold about the anvil in an equal and repetitive form so as to uniquely produce pleated materials on a header that are each equal to each other and parallel to each other.

I claim:

1. A pleat measuring and forming device for accurately reproducing identical plates in a fabric material comprising:

a first contiguous rigid material of uniform thickness having a plurality of first and second scorings alternating on each side of said rigid materials for folding said rigid material accordion style along said alternate scorings, and a second contiguous rigid material having scorings cooperating with the scorings on said first rigid material for folding said first rigid material.

2. A pleat measuring and forming device according to claim 1 in which said first scorings have a substantially V-shaped cross-section on one side of said rigid material and said second scorings have an arcuate cross-section on the opposite side of said rigid material.

3. A pleat measuring and forming device according to claim 2 in which said arcuate cross-section has a substantially large radius of curvature.

4. A pleat measuring and forming device according to claim 1 in which said first and second scorings each reduce the thickness of said first material by substantially 80 percent.

5. A pleat measuring and forming device according to claim 1 in which said first rigid material is constructed of plastic having a thickness of approximately 0.050 inch.

6. A pleat measuring and forming device according to claim 1 in which all of said first scorings and all of said second scorings are parallel to each other.

7. A pleat measuring and forming device according to claim 6 in which the distances between the center lines of alternate scorings are equal.

8. A pleat measuring and forming device according to claim 1 in which said second rigid material has a uniform thickness and comprises a plurality of first and second scorings alternating on each side of said rigid material for folding said rigid material accordion style along said alternate scorings.

9. A pleat measuring and forming device according to claim 8 in which said first scorings have a substantially V-shaped cross-section on one side of said rigid material and said second scorings have an arcuate cross-section on the opposite side of said rigid material.

10. A pleat measuring and forming device according to claim 8 in which said first scorings on said first rigid material are aligned with said second scorings on said second rigid material.

11. A pleat measuring and forming device according to claim 10 in which said first rigid material and said second rigid material are hinged together whereby the first scorings on said first rigid material nest within the second scorings on said second rigid material.

12. A pleat measuring and forming device according to claim 1 in which said second rigid material has a uniform thickness and comprises a plurality of V-shaped scorings on only one side of said rigid material.

13. A pleat measuring and forming device according to claim 12 in which said V-shaped scorings on said second rigid material nests within at least one of said scorings on said first rigid material.

14. A pleat measuring and forming device according to claim 1 in which the first rigid material is folded in half about a first scoring and maintained in said folded positions.

15. A pleat measuring and forming device according to claim 1 in which said second rigid material has a single arcuate scoring on one side and is folded in half to form a substantially U-shaped member.

16. A method of producing a pinch pleat from a single large pleat having a header material that comprises the steps of:

first folding a header material about a guide which will establish the position of the defined pinch pleat, then stitching the folded header material while still encompassing the guide, then folding the guide and the encompassing header material accordion style into three equal parts, then stitching the lowermost portion of the finished pinch pleat, and then removing the guide from within the material thereby leaving a finished pinch pleat.

* * * * *